US007769182B2

(12) United States Patent
Lombardo et al.

(10) Patent No.: US 7,769,182 B2
(45) Date of Patent: Aug. 3, 2010

(54) METHOD AND SYSTEM FOR COMPARING AUDIO SIGNALS AND IDENTIFYING AN AUDIO SOURCE

(75) Inventors: Andrea Lombardo, Milan (IT); Stefano Magni, Milan (IT); Andrea Mezzasalma, Seveso (IT)

(73) Assignee: GFK Eurisko S.R.L., Milan (IT)

( * ) Notice: Subject to any disclaimer, the term of this patent is extended or adjusted under 35 U.S.C. 154(b) by 1119 days.

(21) Appl. No.: 11/431,857

(22) Filed: May 11, 2006

(65) Prior Publication Data

US 2006/0262887 A1 Nov. 23, 2006

(30) Foreign Application Priority Data

May 18, 2005 (IT) ..... MI2005A0907

(51) Int. Cl.
*H04R 29/00* (2006.01)

(52) U.S. Cl. ..... 381/56; 381/58; 340/539.22; 340/539.26; 340/545.2

(58) Field of Classification Search ..... 381/56–58; 340/539.22, 539.26, 545.2; 367/135, 13
See application file for complete search history.

(56) References Cited

U.S. PATENT DOCUMENTS 7,277,766 B1 * 10/2007 Khan et al. ..... 700/94
7,549,052 B2 * 6/2009 Haitsma et al. ..... 713/180
2003/0231775 A1 * 12/2003 Wark ..... 381/56

FOREIGN PATENT DOCUMENTS

| | | |
|---|---|---|
| CA | 2 310 769 A1 | 4/2001 |
| EP | 1 403 783 A2 | 3/2004 |
| WO | WO 02/065782 | 8/2002 |

OTHER PUBLICATIONS

Edirol: "Wave/MP3 recorder" Owner's Manual R-1. [Online] Nov. 18, 2004, XP002419399 Retrieved from the Internet: URL:http://web.archive.org/web/20041118104620/http://www.roland.com/products/en/_support/om.cfm?In=en&dsp=0&iCncd=579> [retrieved on Feb. 9, 2007] the whole document.

* cited by examiner

*Primary Examiner*—Xu Mei
*Assistant Examiner*—Disler Paul
(74) *Attorney, Agent, or Firm*—Modiano & Associati; Albert Josif; Daniel J. O'Byrne

(57) ABSTRACT

A method for defining an index of a match between a content of two audio sources, comprising: sampling audio from a first source and a second source generating a first and second set of samples; selecting a sequential number of samples N belonging to the first set of samples and N samples belonging to the second set; transferring the first and second sequences of N samples to the frequency domain, generating a first and second sequences of N/2 frequency intervals; for the first sequence, calculating the sign of the derivative; for the second sequence, calculating the sign and the absolute value of the derivative, and a total sum of the absolute values of the derivative and a partial sum of the absolute values of the derivative; the ratio between the partial sum and the total sum being an index of the match of the audio sources.

13 Claims, 3 Drawing Sheets

METHOD AND SYSTEM FOR COMPARING AUDIO SIGNALS AND IDENTIFYING AN AUDIO SOURCE

The present invention relates to a method for comparing audio signals and for identifying an audio source, particularly a method which allows to detect passively exposure to radio and television, both in a domestic environment and outdoors, and to a related system which implements such method. The system preferably comprises a device of the portable type, which can be applied during use to a person or can be positioned in strategic points and allows to record constantly the audio exposure to which the person is subjected throughout the day.

BACKGROUND OF THE INVENTION

Currently, the number of radio and television stations that broadcast their signals wirelessly or by cable has become very large and the schedules of each broadcaster are extremely disparate.

Both in an indoor domestic or working environment and outdoors, we are constantly subject to hearing, intentionally or unintentionally, audio that arrives from radio and television sources.

Listening and viewing of a radio or television program can be classified in two different categories: of the active type, if there is a conscious and deliberate attention to the program, for example when watching a movie or listening carefully to a television or radio newscast; of the passive type, when the sound waves that reach our ears are part of the audio background, to which we do not necessarily pay particular attention but which at the same time does not escape from our unconscious assimilation.

Indeed in view of the enormous number of radio and television stations available, it has become increasingly difficult to estimate which networks and programs are the most followed, either actively or passively.

As is known, this information is of fundamental importance not only for statistical purposes but most of all for commercial purposes.

In this context, so-called sound matching techniques, i.e., techniques for recording audio signals and subsequently comparing them with the various possible audio sources in order to identify the source to which the user has actually been exposed at a certain time of day, have been developed.

Sound recognition systems use portable devices, known as meters, which collect the ambient sounds to which they are exposed and extract special information from them. This information, known technically as "sound prints", is then transferred to a data collection center. Transfer can occur either by sending the memory media that contain the recordings or over a wired or wireless connection to the computer of the data collection center, typically a server which is capable of storing large amounts of data and is provided with suitable processing software.

The data collection center also records continuously all the radio or television stations to be monitored, making them available on its computer.

In order to define which radio or television stations have been heard during the day, each sound print detected by a meter at a certain instant in time is compared with said recordings of each of the selected radio and television stations, only as regards a small time interval around the instant being considered, in order to identify the station, if any, to which the meter was exposed at that time.

Typically, in order to minimize the possibility of achieving false positives and false negatives, this assessment is performed on a set of consecutive sound prints.

Although the basic technology is sufficiently developed and affirmed, it has been found that current sound recognition devices are not sufficiently reliable. False recognitions are in fact often obtained or the recognition of a certain audio source fails, especially in the presence of ambient noise which partially covers the sound emitted by a radio or television, as often occurs in real life.

SUMMARY OF THE INVENTION

The aim of the present invention is to overcome the limitations of the background art noted above by proposing a new method for comparing and recognizing audio sources which is capable of extracting sound prints from ambient sounds and of comparing them more effectively with the audio recordings of the radio or television sources.

Within this aim, an object of the present invention is to maximize the capacity for correct recognition of the radio or television station even in conditions of substantial ambient noise, at the same time minimizing the risk of false positives, i.e., incorrect recognition of a station at a given instant.

Another object of the invention is to limit the data that constitute the sound prints to acceptable sizes, so as to be able to store them in large quantities in the memory of the meter and allow their transfer to the collection center also via data communications means.

Another object of the present invention is to limit the number of mathematical operations that the calculation unit provided on the meter must perform, so as to allow an endurance which is sufficient for the typical uses for which the meter is intended despite using batteries having a limited capacity and a conventional weight.

This aim and these and other objects, which will become better apparent hereinafter, are achieved by a method for comparing the content of two audio sources, comprising the steps of: defining a set of sampling parameters; sampling audio from a first source according to said sampling parameters, generating a first set of samples, and audio from a second source according to said sampling parameters, generating a second set of samples; selecting a sequential number of samples N which belongs to said first set of samples and an identical number of samples N to be compared which belong to said second set of samples; transferring said first sequence of N samples to the frequency domain, generating a first sequence of N/2 frequency intervals, and transferring said second sequence of N samples to the frequency domain, generating a second sequence of N/2 frequency intervals; for said first sequence of N/2 frequency intervals, calculating the sign of the derivative; for said second sequence of N/2 frequency intervals, calculating the sign of the derivative and the absolute value of the derivative and calculating a total sum constituted by the sum of the absolute values of the derivative in each frequency interval ranging from a lower limit to an upper limit; for said second sequence of N/2 frequency intervals, calculating a partial sum constituted by the sum of the absolute values of the derivative in each frequency interval ranging from a lower limit to an upper limit, wherein the sign of the derivative in the frequency interval that belongs to said second sequence coincides with the sign of the derivative of the corresponding frequency interval in said first sequence; using the ratio between said partial sum and said total sum as an index of the match between said content of said audio sources.

This aim and these and other objects are also achieved by a system for comparing the content of two audio sources, characterized in that it comprises: sampling means for sampling audio from a first source according to sampling parameters, generating a first set of samples, and audio from a second source according to said sampling parameters, generating a second set of samples; means for transforming in the frequency domain a sequential number of samples N which belong to said first set of samples and an equal number of samples N to be compared which belong to said second set of samples, generating a first sequence of N/2 frequency intervals and a second sequence of N/2 frequency intervals; means for calculating, for each frequency interval of said first sequence, the sign of the derivative and for calculating, for said first sequence of N/2 frequency intervals, the sign of the derivative, the absolute value of the derivative and a total sum constituted by the sum of the absolute values of the derivative in each frequency interval ranging from a lower limit to an upper limit; means for calculating, for said second sequence of N/2 frequency intervals, a partial sum constituted by the sum of the absolute values of the derivative in each frequency interval ranging from a lower limit to an upper limit, wherein the sign of the derivative in the frequency interval that belongs to said second sequence coincides with the sign of the derivative of the corresponding frequency interval in said first sequence; means for determining the ratio between said partial sum and said total sum in order to obtain an index of the match of said content of said audio sources.

Advantageously, the sampling parameters include the sampling frequency and the number of bits per sample or equivalent combinations.

Conveniently, the first audio source is constituted by the environment that surrounds a recording device, while the second source is constituted by a radio or television station.

Advantageously, in order to identify a possible radio or television station whose audio has been detected at a given instant by the recording device, it is useful to mark with a timestamp the time when the recording of the first audio source or ambient audio source was made, so as to perform, in a plurality of recordings of second radio and TV sources, a comparison in time intervals which are delimited in the neighborhood of the instant identified by the timestamp.

BRIEF DESCRIPTION OF THE DRAWINGS

Further characteristics and advantages of the invention will become better apparent from the following detailed description, given by way of non-limiting example and accompanied by the corresponding figures, wherein.

DESCRIPTION OF THE PREFERRED EMBODIMENTS

Figure 1:
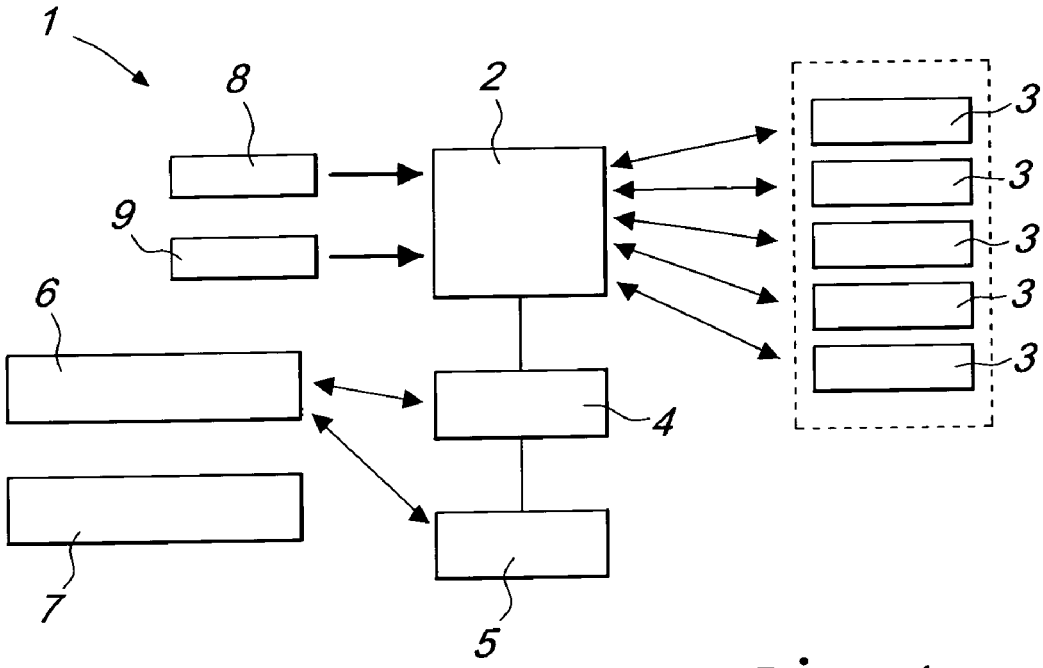
FIG. 1 is a block diagram related to a method and a system for comparing audio signals and identifying an audio source according to the present invention.

An exemplifying architecture of data processing of the system according to the present invention is summarized in the block diagram of FIG. 1.

The data 8, 9 in input to the system 1, i.e., files 8 from radio and television sources which have been appropriately encoded, for example in the WAV format, and data 9 from meters 11, described in detail hereinafter, are stored by a storage system 2, which is shared by a set of clusters 3 and by the system controller or master 4.

The state of the processing, the location of the results and the configuration of the system are stored in a relational database 5.

The system 1 is completed by two further components, which are referenced here as "remote monitor system" 6 and "remote control system" 7. The former is responsible for checking the functionality and operativity of the various parts of the system and for reporting errors and anomalies, while the latter is responsible for controlling and configuring the system.

The files 8 that arrived from radio and television stations are preferably converted into spectrum files for subsequent use according to the description that follows.

The machine 3 selected by the controller 4 on the basis of its availability of CPU copies to its local disk the audio files 8 and converts them into spectrum files on the local disk. At this point, the machine 3 becomes the preferential candidate for analysis of the radio signal that has just been transformed toward the data 9 that arrive from the meters 11, according to the methods described hereinafter.

In particular, the machine 3 designated by the controller 4 copies to its RAM memory the files 8, converted into spectrum files, that it already has, and copies locally, or uses via NFS, the meter files 9 for analysis, and then saves the results to its own disk. At the end of the analysis of the data 9 of all the meters 11, it copies the result files to the storage system 2.

Finally, the data distributed over different files and machines are collected to produce the end result, i.e., the comparison of the individual meter 11 with respect to all the radio and television channels.

Communications between the controller 4 and the individual elements of the processing cluster 3 occur preferably by means of a message bus. Owing to this bus, the controller 4 can query with broadcast messages the cluster 3 or the individual processing units and know their status in order to assign the processing tasks to them.

The system is characterized by complete modularity. The individual processing steps are assigned dynamically by the controller 4 to each individual cluster 3 so as to optimize the processing load and data distribution. The logic of the processing and the dependencies among the processing tasks are managed by the controller 4, while the elements 3 of the cluster deal with the execution of processing.

Figure 2:
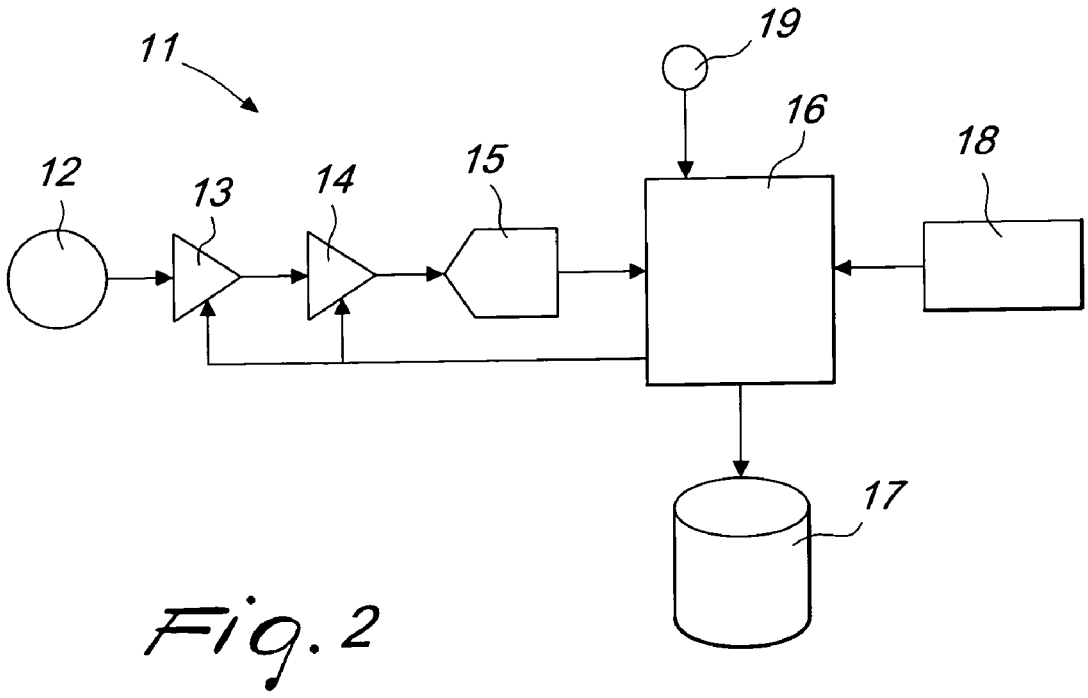
FIG. 2 is a block diagram related to a portable sound recording unit, according to a preferred embodiment of the system according to the present invention.

With reference now to FIG. 2, the meter 11 comprises an omnidirectional microphone 12, two amplifier stages 13 and 14 with programmable gain, an analog/digital signal converter 15, a processor or CPU 16, storage means 17, an oscillator or clock 18, and interfacing means 19, for example in the form of buttons.

Operation of the recording device is as follows.

The omnidirectional microphone 12 picks up the sound currently carried through the air, which is constituted by a plurality of sound sources, including for example a radio or television audio source.

The two PGA amplifier stages 13 and 14 with programmable gain amplify the microphone signal in order to bring it to the input of the ADC converter 15 with a higher amplitude.

The ADC converter converts the signal from analog to digital with a frequency and a resolution adapted to ensure that a sufficiently detailed signal is preserved without using an excessive amount of memory. For example, it is possible to use a frequency of 6300 Hz with the resolution of 16 bits per sample.

The processor 16 acquires the samples and performs the Fourier transforms in order to switch from the time domain to the frequency domain. Moreover, in the preferred embodiment, the processor 16 changes at regular intervals, for example every 5 seconds, the gain of the two amplifier stages 13 and 14 in order to optimize the input to the ADC converter 15.

The result of the processing of the processor 16 is recorded in the memory means 17, which may be of any kind, as long as they are nonvolatile and erasable. For example, the memory means 17 can be constituted by any memory card or by a portable hard disk.

The acquisition frequency, the precision whereof is fundamental for the field of application, is generated by a temperature-stabilized oscillator 18, which operates for example at 32768 Hz.

The button 19 activates the possibility to record a sentence for identifying the individual who performed the recording, so as to add corollary and optional information to the data acquired by the meter 11 in the time interval being considered.

With reference now to the flowchart of FIG. 3, the detailed operation of the recording method 30 used by the meters 11 in the data acquisition step is as follows.

In step 31, the processor 16 acquires a first sequence of successive samples, which correspond to a given time interval depending on the sampling frequency. The sequence comprises a number of samples N_CAMPIONI_TOTALI, for example 1280 samples S(1)-S(1280).

A number N of samples, for example 256, smaller than the total number of samples, to be processed progressively in successive blocks, is defined. At the same time, the value N_ITER, calculated as the ratio between N_CAMPIONI_TOTALI and N, defines the number of cycles that must be completed in order to finish the processing of the acquired audio samples.

In step 32, the counter variable I is initialized to the value 1.

In step 33, the first N samples, 256 in this example, are transferred to a spectrum calculation routine, generating the information related to N/2 frequency intervals related to the I-th cycle, in the specific case 128 intervals:

$$\{S(1)\text{-}S(256)\}\text{-->}\{F(1,1)\text{-}F(1,128)\},$$

an exemplifying case of the generic formula $$\{S((I-1)*N/2+1)-S((I-1)*N/2+N)\}\text{-->}\{F(I,1)\text{-}F(I,128)\}.$$

Step 34 checks that the procedure is iterated for a number of times sufficient to complete the full scan of the acquired samples, progressively performing sample transformation.

In particular, once transformation has been completed on the first N samples, in step 35 the counter I is increased by 1 and the processor 16 jumps again to step 33 for processing the next 256 samples, which partially overlap the first ones with a level of overlap which is preferably equal to 50%, for a total of N/2 overlapping samples.

In the example there are 128 overlapping samples in the interval of 256 samples being considered, thus performing the following transform:

$$\{S(129)\text{-}S(384)\}\text{-->}\{F(2,1)\text{-}F(2,128)\}.$$

The process is thus iterated until the samples comprised between 1025 and 1280 are analyzed and are transformed into information related to the frequency interval F(9,1)-F(9,128):

$$\{S(1025)\text{-}S(1280)\}\text{-->}\{F(9,1)\text{-}F(9,128)\}.$$

In step 36, having obtained at this point N_ITER sets of transforms, they are added, for each index I ranging from 1 to N/2:

$$F(I)=F(1,I)+F(2,I)+\ldots+F(N_ITER,I).$$

In the exemplifying embodiment, the index I ranges from 1 to 128, and one obtains:

$$F(I)=F(1,I)+F(2,I)+F(3,I)+F(4,I)+F(5,I).$$

In step 37, a process begins for evaluation of the sign of the derivative D(I) of each interval, where the index "I" ranges from 2 to N/2, where D(1) is always set equal to zero and is not used for subsequent comparison between sound prints.

Step 38 checks whether the value F(I) is greater than the value F(I−1) calculated previously.

If it is, the value of the derivative D(I)=1 is set in step 39.

If it is not, i.e., if F(I)<=F(I−1), then D(I)=0 is set in step 40.

In step 41, the processor checks whether the counter I still has a value which is lower than N/2.

If it does, the counter is incremented by one unit in step 42 and the cycle resumes in step 38, until the process ends in step 43.

In this manner, a sequence of N/2 bits, 128 bits in the example, is thus finally achieved.

The sequence of bits thus obtained is then recorded in the storage means 17, ready to be transmitted or loaded into the server of the data collection center.

Of course, the person skilled in the art easily understands that the operations for transforming and calculating the derivative can be performed on subsets of the number of total samples acquired in the unit time. For example, it is possible to record 6400 samples and still work on subsets of 1280 samples at a time, obtaining 5 sequences of signs of derivatives for each sampling. Sampling, in turn, can be repeated at a variable rate, for example every 4 seconds.

Finally, at the end of the processing process, the meter 1 emits, according to a programmed sequence, an acoustic and/or visual signal in order to ask the user optionally to record a brief message, for example the user's name. This message is recorded in the memory 17 in appropriately provided files which are different from the ones used to store the sequences of derivative signs obtained above, and is used at the data collection center to identify the user who used the meter 11 being considered.

By means of a serial SPI connection or an appropriate circuit, the device 11 is recharged and synchronized by using a DCF77 radio signal or, in countries where this is appropriate, other radio signals. It is in fact essential for each file to be timestamped with great precision, in order to be able to make the comparisons between signals recorded by the devices 11 and signals emitted by the radio stations at the same instant or exclusively in a limited neighborhood thereof, in order to limit processing times and avoid the possibility of error if a same signal is broadcast by the same station or by two different stations at subsequent times. For this purpose, the monitoring units must have a very accurate synchronization system, such as, as mentioned, the DCF77 radio signal or the like or, as an alternative, a GPS or Internet signal.

Moreover, on the basis of the reception delay that is inherent to the various broadcasting platforms, the high level of accuracy and precision used for timestamping can be used indeed to identify the type of broadcasting platform used. It is thus possible to distinguish, for example, whether the audio content that arrives from one station has been received in FM rather than in DAB, and so forth.

Going back to the system described schematically in FIG. 1, the operation of the server of the collection center comprises storage means, for example in the form of a hard disk, which are adapted to store the audio of the radio stations and TV stations involved in the measurement.

The audio of each radio or TV station involved in the measurement is recorded on hard disk, with a preset frequency, for example 6300 samples per second, 16 bits per sample, in mono. With this standard, the recording of a radio or TV station for 24 hours requires approximately 1 Gigabyte of memory and ensures a compromise between recording quality and required storage space. Better audio quality is in fact not significant for the purposes of the sound comparison or sound matching process on which the invention is based.

If CD-quality audio recordings, i.e., recordings sampled at 44100 Hz, 16 bits stereo, are already available, it is of course possible to mix digitally the two stereo channels and obtain files of the required type. For example, it is possible to average the samples of the two stereo channels in order to obtain a mono file and extract one sample every 7, thus obtaining a mono file at 6300 Hz, 16 bits.

Likewise, the person skilled in the art easily understands that it is possible to convert information which is already available, sampled with different frequencies or bit rates, so as to meet the sampling parameters selected for performing the sound comparison and recognition functions.

If it is necessary to record locally one or more radio or TV stations and transfer by data communications system the recordings 8 to the servers of the collection center, if a sufficient bandwidth is not available, it is possible to compress further the audio files by using lossless compression algorithms, or, if necessary, lossy ones, such as MP3.

Lossless compression algorithms are scarcely effective on audio files but ensure the possibility to reconstruct the received information perfectly at destination. Lossy compression algorithms do not allow perfect reconstruction of the original signal and inevitably this compression reduces the performance of the system. However, the degradation can be more than acceptable if a limited compression ratio is selected.

Another alternative is to proceed, directly during the recording of the radio and television stations, with the conversion of the audio to the frequency domain, as will be described hereinafter with reference to the core of the present invention, and transfer the data already in this form, optionally applying, in this case also, lossless or lossy compression algorithms.

At this point, once the data 8 and 9 have been made available to the computer of the collection and processing center as described above, it becomes possible to search for the radio or television station 8 that had possibly been picked up by the meter 11 and recorded thereby at a certain time t.

The sound print of the recording 9 extracted by the meter 11 at the time t must therefore be compared with each recording 8 that arrives from radio or television sources at each time t', where the times t' are comprised in the neighborhood of the time t. In ideal conditions, the time t' would coincide with t, but in reality it is necessary to shift it slightly so as to take into account the possible reception delays, which depend on the type of radio broadcast (AM, FM, DAB, satellite, Internet) and/or on the geographical area where the signal is received.

Likewise, an interval is defined which is representative of the scanning step, which can be determined easily experimentally, such as to balance the effectiveness of recognition with the amount of processing to be performed.

The scan performed within the defined interval and with the defined step allows to identify the "optimum" synchronization, i.e., a value which maximizes the degree of associability between the sound print extracted from the meter at the time t and the recording of a radio or television station at each time t'.

This search for "optimum" synchronization is performed by considering in combination the series of sound prints acquired by the meter over a suitable time interval, which can be, depending on the circumstances, 1 second, 15 seconds, 30 seconds, and so forth.

In order to maximize the efficiency of identification and reduce the processing load, it is also possible to perform the scan in two steps: initially with a greater scanning step, in order to identify the "potential" associations, and then with a finer scanning step, in order to validate the identification with greater precision.

Figure 4:
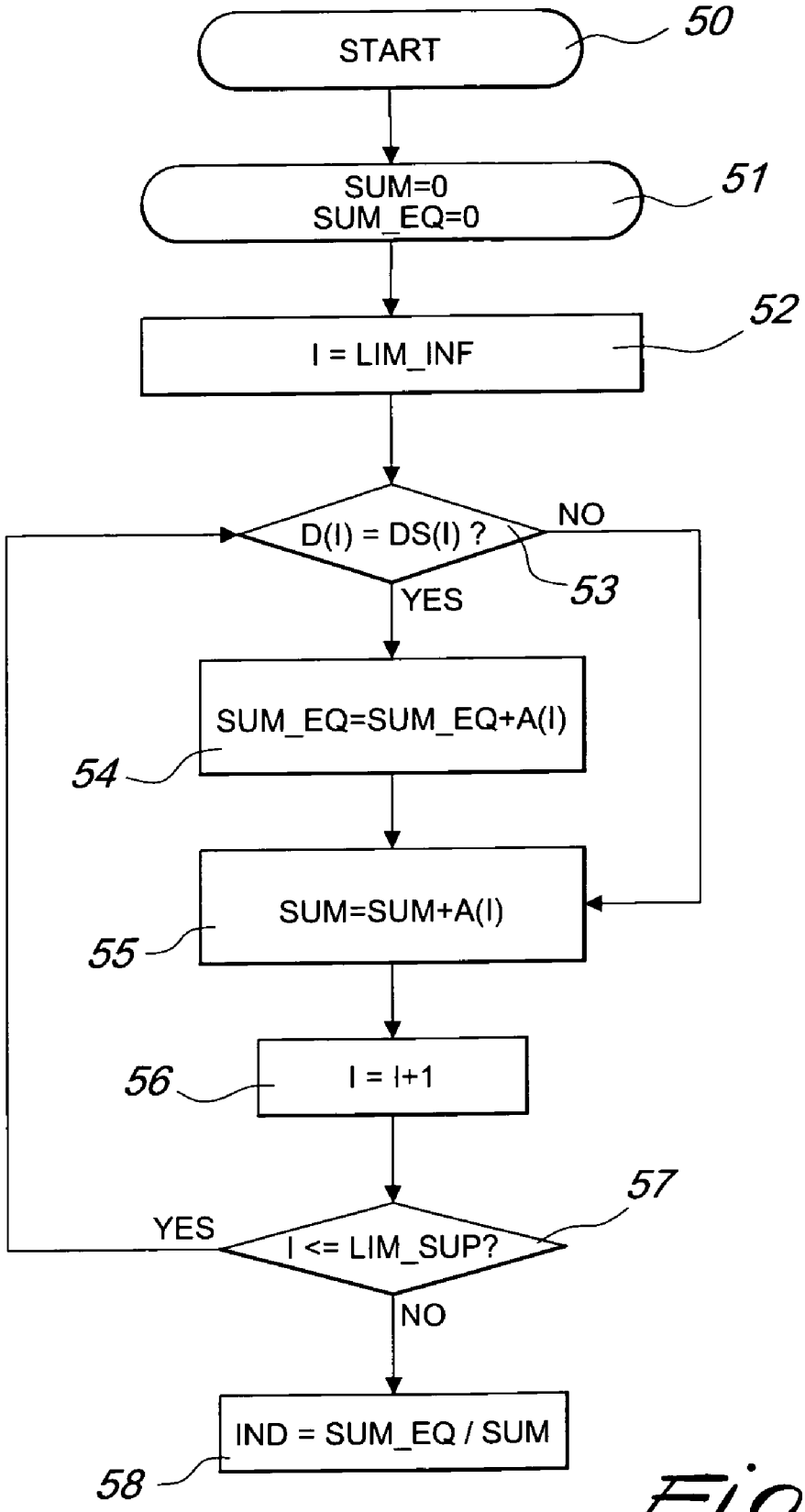
FIG. 4 is a flowchart of the method for comparing audio sources on which the present invention is based.

This having been said, with reference to FIG. 4, the method on which the present invention is based is now described; it measures the degree of association or similarity between the sound print detected by a meter 11 at the time t and the recording of a radio or television source at a corresponding time t' as defined above.

Figure 3:
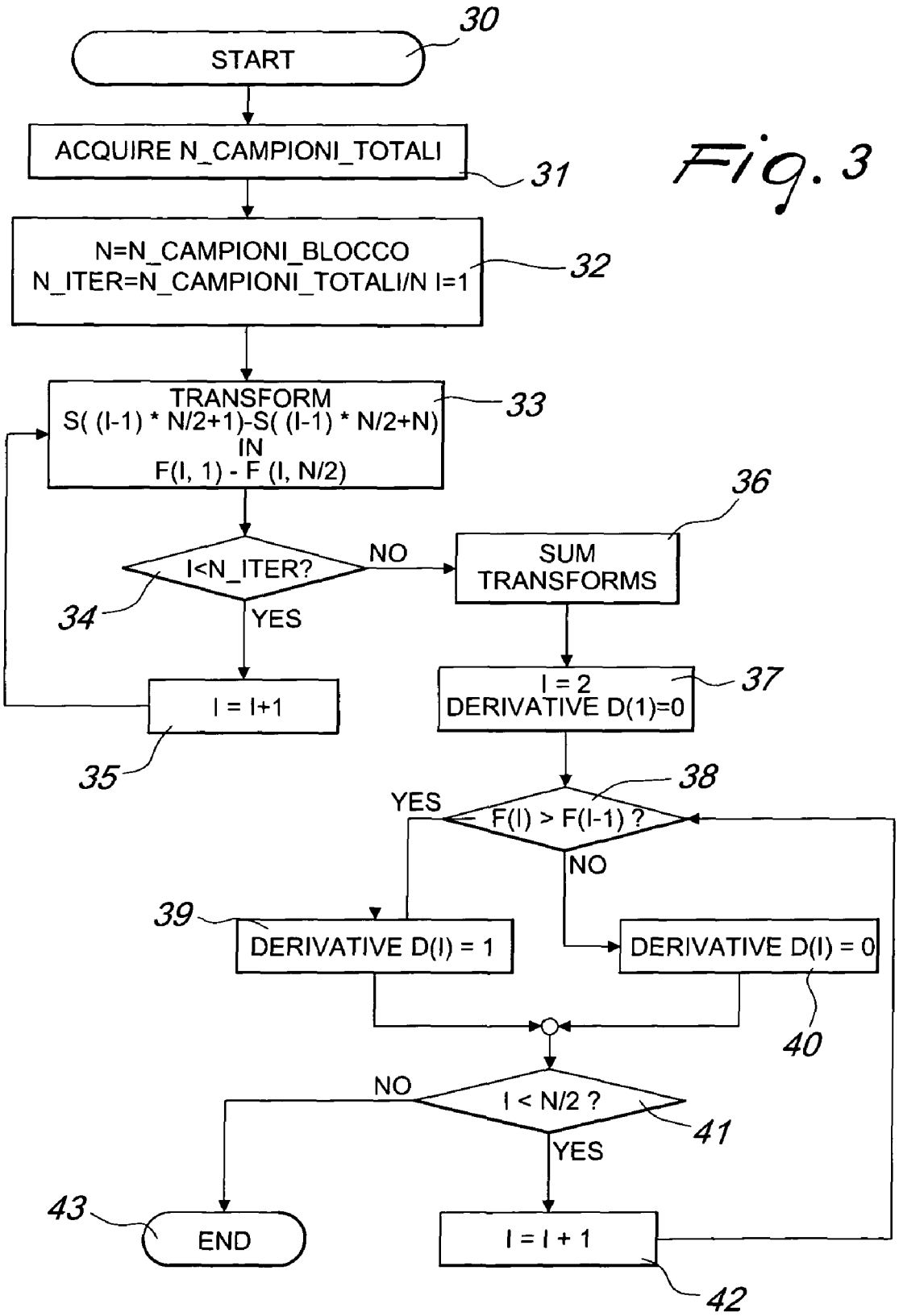
FIG. 3 is a flowchart of operation during sound recording according to the present invention.

First of all, the same method described with reference to FIG. 3 is performed also on the data 8 of the radio or television source to be compared.

The only difference is the calculation, to be performed in steps 39 and 40 of the flowchart, of the absolute value:

$$A(I)=|F(I)-F(I-1)|,$$

for each I ranging from 2 to N/2.

A sequence of N/2 values, 128 values in the example, is thus obtained in which A(I) is always set to zero and is not used by the comparison algorithm.

The fundamental index IND of association between the sound print picked up by the meter 1 at the time t and the recording of the radio or TV source at the time t' as defined above is the percentage of derivatives that have the same sign in the "meter" sample 8 and in the "source" sample 9, weighed with the absolute value of each derivative of the "source" sample.

With reference to the method 50 described in the flowchart of FIG. 4, the symbol D(I) designates the sign of the i-th derivative of the frequency distribution that arrives from the meter 11 and DS(I) designates the sign of the i-th derivative of the frequency distribution that arrives from the radio or television source, while A(I) identifies the absolute value of the i-th derivative of the frequency distribution that arrives from the source.

A lower limit LIM_INF is also defined which is for example set to 7 and is intended to exclude from the calculation the lowest frequencies, which are scarcely significant. Likewise, it is possible to define an upper limit LIM_SUP, which can be used to reject frequencies above a certain threshold or typically is set to the upper limit of available frequency intervals, which is equal to N/2 or 128 in the example.

Finally, the variable SUM indicates the sum of the absolute values of the derivatives in the frequency distribution of the audio source and the variable SUM_EQ designates the sum of the absolute values of the derivatives in the frequency distribution of the audio source for the frequency intervals in which the sign of the derivative of the data file 9 recorded by the meter 11 coincides with the sign of the derivative of the file 8 recorded directly from the radio or television source.

In step 51, the values SUM and SUM_EQ are initialized to zero.

In step 52, the counter I is set to the lower frequency limit.

In step 53, the processor checks whether the sign of the derivative in the I-th frequency interval in the data file 9 that corresponds to the recording that arrives from the meter 11 is equal to the sign of the derivative in the corresponding frequency interval in the file 8 of the audio source with respect to which the comparison is being made.

If it is, the value SUM_EQ is incremented in step 54 by an amount equal to the absolute value A(I) in order to move on to step 55, where the value SUM is increased by an equal amount.

If it is not, only the value SUM is increased in step 55.

In step 56, the counter I is increased by one unit, and step 57 checks whether the counter I has reached the upper limit of frequency intervals to be considered.

If it has not, the cycle is resumed at step 53, until all the frequency intervals in the defined interval have been considered.

At this point, in step 58, the ratio IND=SUM_EQ/SUM is calculated and the method ends.

This value ranges from 0 to 1, with a theoretical average of 0.5. The actual average, however, is higher than 0.5 both due to the scanning, which leads to identification of the maximum value within the scanning interval and due to the tendency, which relates especially to music programming, to have relatively similar audio frequency distributions due to the use of standard notes.

In other words, the association index described here measures the similarity of form between the frequency distribution detected by the meter at the time t and the frequency distribution detected by the radio/TV source at the time t', assigning greater relevance to frequency intervals in which the derivative of the frequency distribution of the radio or television source is more significant.

In practice, this is equivalent to "seeking", within the meter sample, the significant information of the source sample, which have the highest probability of emerging from the ambient sound that may be present.

In order to avoid false positives and false negatives in the identification of the radio and television station to which the meter 11 has been exposed at the time t, it is preferable to consider in combination the set of the indexes of association between the meter 11 and the radio and television source being considered for a time period comprised within an adequate time interval, for example on the order of a few tens of seconds.

For the time t, the meter 11 is therefore associated with the radio or television station with which the comparison has been made if the average of the indexes calculated in the time interval being considered is higher than a given threshold, which can be determined experimentally so as to minimize false positives and false negatives and can be varied at will depending on the degree of certainty that is to be obtained.

It is further possible to use, instead of a simple average of the indexes of association, significativity tests which take into account the distribution of the absolute values of the derivatives of the frequency distributions acquired from the radio or television sources, in order to avoid false positives if the absolute values of said derivatives are concentrated over a small number of intervals.

It has thus been shown that the described method and system achieve the intended aim and objects. In particular, it has been shown that the system thus conceived allows to overcome the qualitative limitations of the background art, improving results in the recognition of audio sources broadcast in the environment.

Numerous modifications are of course evident and can be performed promptly by the person skilled in the art without abandoning the scope of the protection of the present invention. For example, it is obvious for the person skilled in the art to change the sampling parameters or the times for comparison of two sample sequences.

Likewise, it is within the common knowledge of any information-technology specialist to implement programmatically the described comparison method by using optimization techniques which do not alter in the inventive concept on which the invention is based.

Therefore, the scope of the protection of the claims must not be limited by the illustrations or by the preferred embodiments given in the description by way of example, but rather the claims must comprise all the characteristics of patentable novelty that reside within the present invention, including all the characteristics that would be treated as equivalent by the person skilled in the art.

The disclosures in Italian Patent Application No. MI2005A000907 from which this application claims priority are incorporated herein by reference.

What is claimed is:

1. A method for defining an index of a match between a content of two audio sources, comprising the steps of:

a) defining a set of sampling parameters;

b) sampling audio from a first source according to said sampling parameters, generating a first set of samples, and audio from a second source according to said sampling parameters, generating a second set of samples;

c) selecting a sequential number of samples N which belong to said first set of samples and an identical number of samples N to be compared which belong to said second set of samples;

d) transferring said first sequence of N samples to the frequency domain, generating a first sequence of N/2 frequency intervals, and transferring said second sequence of N samples to the frequency domain, generating a second sequence of N/2 frequency intervals;

for said first sequence of N/2 frequency intervals, calculating the sign of the derivative;

e) for said second sequence of N/2 frequency intervals, calculating the sign of the derivative and the absolute value of the derivative and calculating a total sum constituted by the sum of the absolute values of the derivative in each frequency interval comprised between a lower limit and an upper limit;

f) for said second sequence of N/2 frequency intervals, calculating a partial sum constituted by the sum of the absolute values of the derivative in each frequency interval comprised between a lower limit and an upper limit, wherein the sign of the derivative in the frequency interval that belongs to said second sequence coincides with the sign of the derivative of the corresponding frequency interval in said first sequence;

g) using the ratio between said partial sum and said total sum as an index of the match of said content of said audio sources.

2. The method according to claim 1, wherein said sampling parameters include: the sampling frequency and the number of bits per sample.

3. The method according to claim 2, wherein said sampling frequency is equal to 6300 Hz.

4. The method according to claim 2, wherein said number of bits per sample is equal to 16.

5. The method according to claim 1, wherein said first audio source is an ambient sound recording.

6. The method according to claim 1, wherein said second sound source is a radio or television station.

7. A system for comparing a content of two audio sources, comprising:

a) sampling means for sampling audio from a first source according to sampling parameters, generating a first set of samples, and audio from a second source according to said sampling parameters, generating a second set of samples;

b) means for transforming in the frequency domain a sequential number of samples N which belong to said first set of samples and an equal number of samples N to be compared, which belong to said second set of samples, generating a first sequence of N/2 frequency intervals and a second sequence of N/2 frequency intervals;

c) means for calculating, for each frequency interval of said first sequence, the sign of the derivative and for calculating, for said first sequence of N/2 frequency intervals, the sign of the derivative, the absolute value of the derivative and a total sum constituted by the sum of the absolute values of the derivative in each frequency interval comprised between a lower limit and an upper limit;

d) means for calculating, for said second sequence of N/2 frequency intervals, a partial sum constituted by the sum of the absolute values of the derivative in each frequency interval comprised between a lower limit and an upper limit, if the sign of the derivative in the frequency interval that belongs to said second sequence coincides with the sign of the derivative of the corresponding frequency interval in said first sequence;

e) means for determining the ratio between said partial sum and said total sum in order to obtain an index of the match of said content of said audio sources.

8. The system according to claim 7, wherein said sampling parameters include: the sampling frequency and the number of bits per sample.

9. The system according to claim 8, wherein said sampling frequency is 6300 Hz.

10. The system according to claim 8, wherein said number of bits per sample is 16.

11. The system according to claim 7, further comprising interface means for recording the data of a radio or television station.

12. The system according to claim 7, further comprising a portable data acquisition device for said first audio source.

13. A portable device for recording ambient sounds for a system according to claim 7.

* * * * *